US007335138B2

(12) United States Patent
Lee

(10) Patent No.: US 7,335,138 B2
(45) Date of Patent: Feb. 26, 2008

(54) SPRING COMPONENT STRUCTURE OF A HOPPER FOR FITNESS USE

(76) Inventor: Yan-Yee Lee, No. 16, Lane 667, Chung San Road, Shen Kang Hsiang, Taichung Hsien (TW)

( * ) Notice: Subject to any disclaimer, the term of this patent is extended or adjusted under 35 U.S.C. 154(b) by 0 days.

(21) Appl. No.: 10/977,835

(22) Filed: Nov. 1, 2004

(65) Prior Publication Data

US 2005/0233869 A1 Oct. 20, 2005

(30) Foreign Application Priority Data

Apr. 15, 2004 (TW) ..... 93205811 U

(51) Int. Cl.
*A63B 21/00* (2006.01)

(52) U.S. Cl. ..... 482/77; 482/79; 482/75

(58) Field of Classification Search ..... 482/77, 482/79, 111; D21/66, 67, 77, 413, 672, 811
See application file for complete search history.

(56) References Cited

U.S. PATENT DOCUMENTS

| | | | | |
|---|---|---|---|---|
| 5,102,119 | A * | 4/1992 | Gerlach | 482/77 |
| 5,292,295 | A * | 3/1994 | Gerlach | 482/77 |
| 5,916,071 | A * | 6/1999 | Lee | 482/77 |
| 6,318,001 | B1 * | 11/2001 | Lee | 36/27 |
| 6,436,012 | B1 * | 8/2002 | Naville | 482/77 |

* cited by examiner

*Primary Examiner*—Jerome Donnelly
(74) *Attorney, Agent, or Firm*—Egbert Law Offices

(57) ABSTRACT

A hopper includes a handrail, a treadle, and a spring component, which is installed at the bottom of the hopper and touches the ground. The treadle is placed above the spring component and the handrail is place above the treadle and extends upward. The spring component has upper and lower arc boards and an auxiliary spring component. The upper and the lower arc boards assemble together to form a spring frame. The top of the upper arc board is fixed with the treadle and the lower arc board meets the ground. The auxiliary spring component is placed between the upper and lower arc boards to enhance the spring force of the arc boards as well as structural strength.

1 Claim, 10 Drawing Sheets

SPRING COMPONENT STRUCTURE OF A HOPPER FOR FITNESS USE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a hopper for fitness purposes, and more particularly to a hopper which is comprised with upper and lower arc boards, and auxiliary spring components.

BACKGROUND OF THE INVENTION

Traditional hopper is well known to us. It has an erecting pole, on the top of which there is a T type handrail and the other end is a column touching the ground. At certain height from the end there is a treadle for a user to step on. Between the treadle and the touching end, there is a spring, which pulls the treadle back to place. However, due to the limited touching area between the hopper and the ground, this traditional hopper requires excellent balance, which is quite different for learners and common users. They would lose interest in the hopper as they cannot jump on it for a long period. Therefore, a new hopper for fitness purpose, which is suitable for common users to jump for long time, has become the goal for manufacturers to improve.

BRIEF SUMMARY OF THE INVENTION

The improvements of this invention are:

1. Provide a spring component, which is composed of upper and lower arc boards as well as auxiliary spring component, to new hopper.

2. With this improvement, a new hopper, which is easy to control with greater touching area, is made possible for learners and common users.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
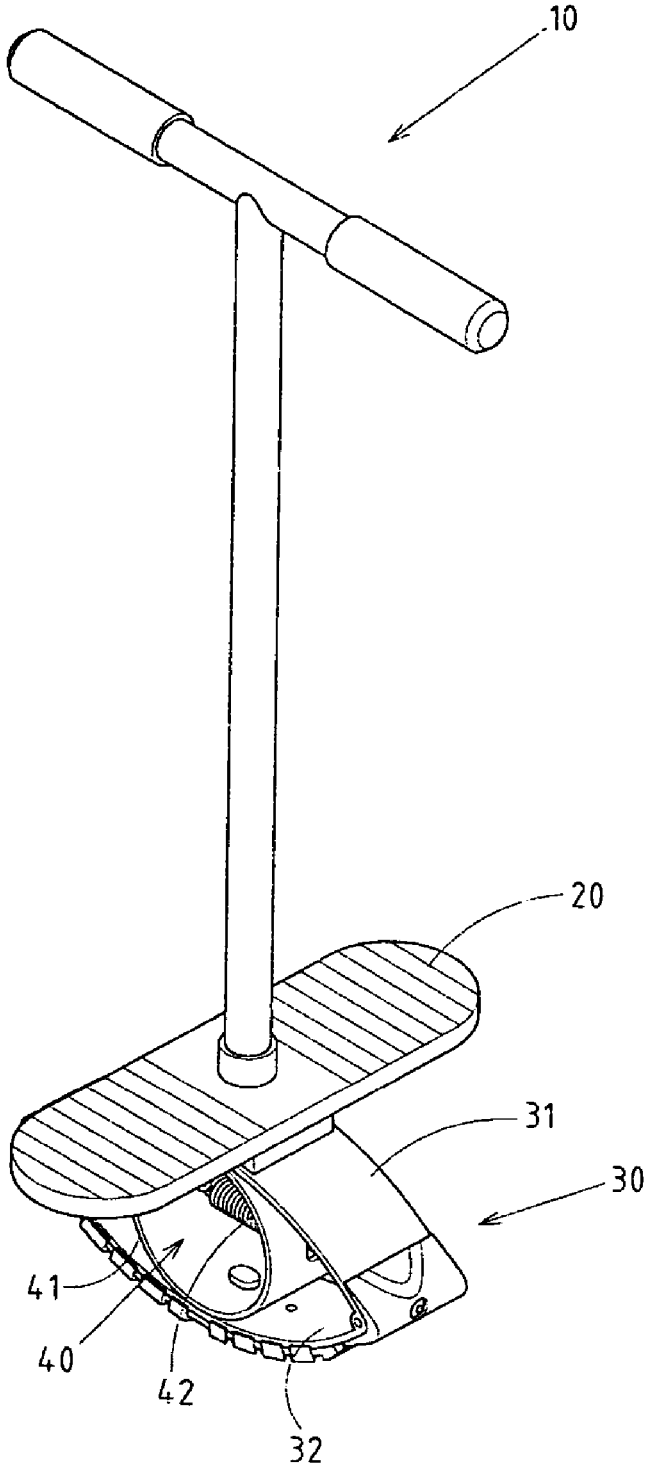
FIG. 1 shows a perspective view of the preferred embodiment of the present invention.
Figure 2:
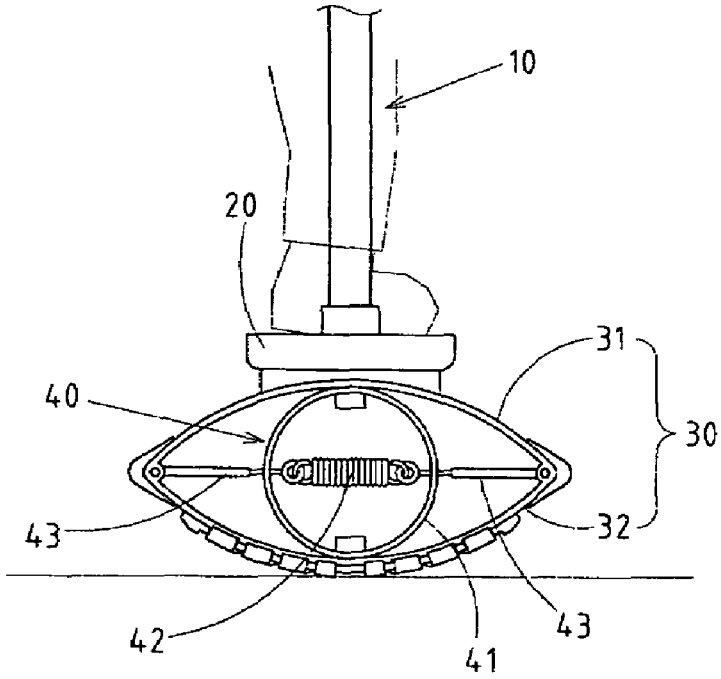
FIGS. 2-3 show the schematic diagram of the preferred embodiment of the present invention.
Figure 3:
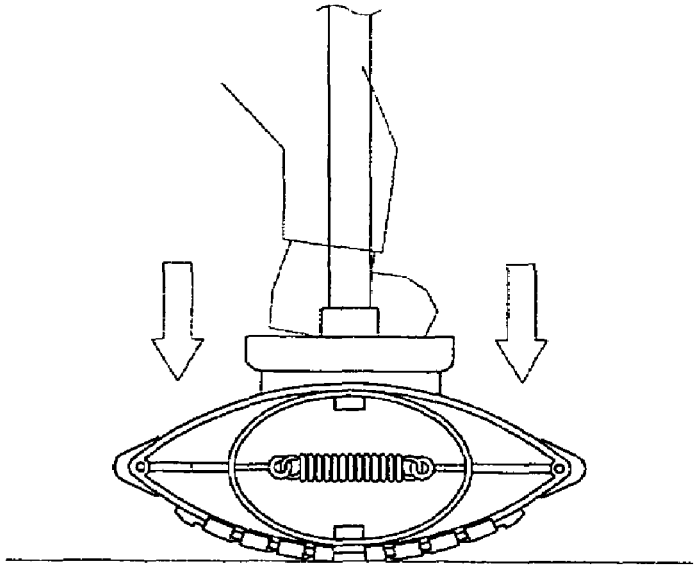

As shown in FIGS. 1-2, a hopper embodied in the present invention comprises:

a handrail 10, a treadle 20 and a spring component 30; where the spring component 30 is installed at the end of the hopper to touch down on the ground. The treadle 20 is placed above the spring component 30, on which the user can put his/her feet. The handrail 10 is installed above the treadle 20 and extends upward. It features:

The spring component 30 is composed of upper arc board 31, lower arc board 32 and auxiliary spring component 40. The upper and lower arc boards 31 32 constitute a spring frame. The upper end of the upper arc board 31 is assembled with the treadle 20 by screws. The lower arc board 32 touches the ground at the bottom face. The spring frame formed by the upper and lower arc boards 31 32 would spring backward as the treadle 20 pushes it. This auxiliary spring component 30 is placed between the upper and lower arc boards 31 32 to enhance the spring force and the structural strength of the two arc boards.

As shown in FIG. 1, the upper and the lower arc boards 31 32 can be integrated part.

Figure 4:
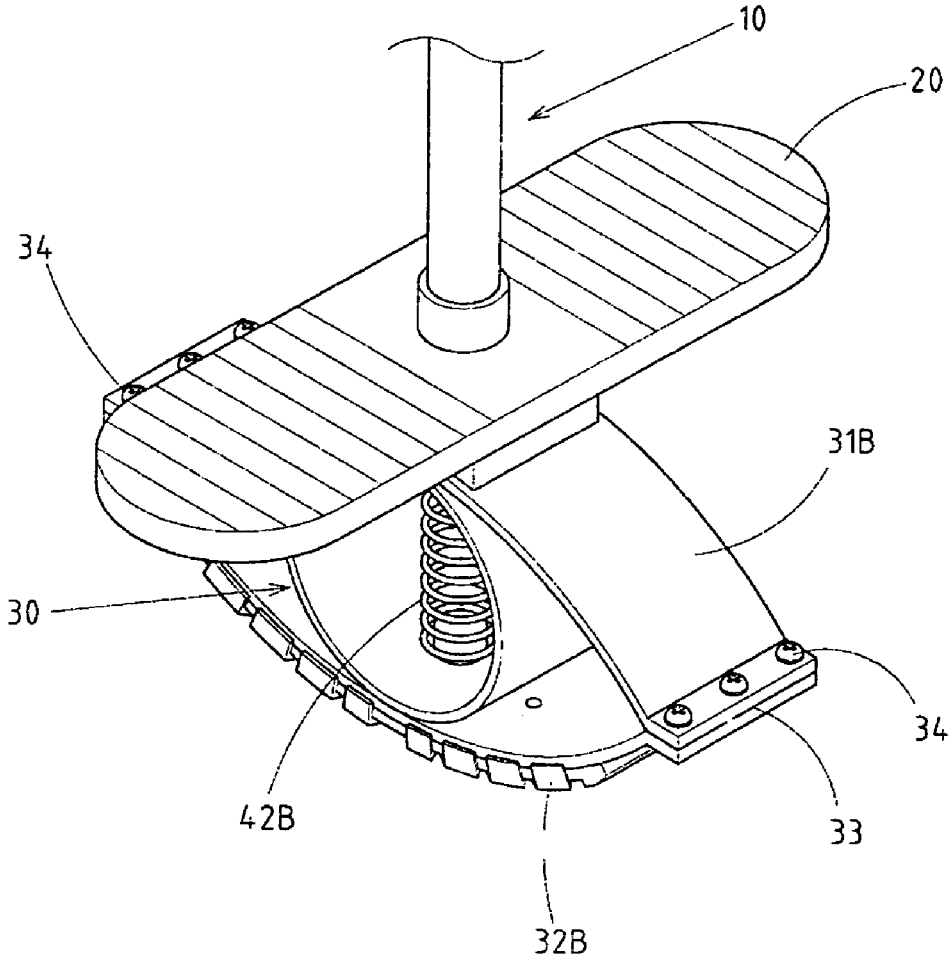
FIGS. 4-6 show other schematic diagrams of the present invention.

As shown in FIG. 4, the upper and lower arc boards 31 32 can be two separate parts. Both their two ends can be shaped as meeting face 33 to meet together and fixed by fixing component 34 (such as screws).

As shown in FIG. 1, the auxiliary spring component 40 can be a round spring frame 41 matched with a horizontal spring 42. This round spring frame 41 is placed within the frame formed by the upper and lower arc boards 31 32. Both ends of the spring 42 are respectively connected with the horizontal ends of the upper and lower arc boards 31 32. The ends of spring 42 can be hooked on pin 43, which is located at the both ends of the upper and lower arc boards 31 32.

As shown in FIG. 4, the spring 42B can also be hooked vertically.

Figure 5:
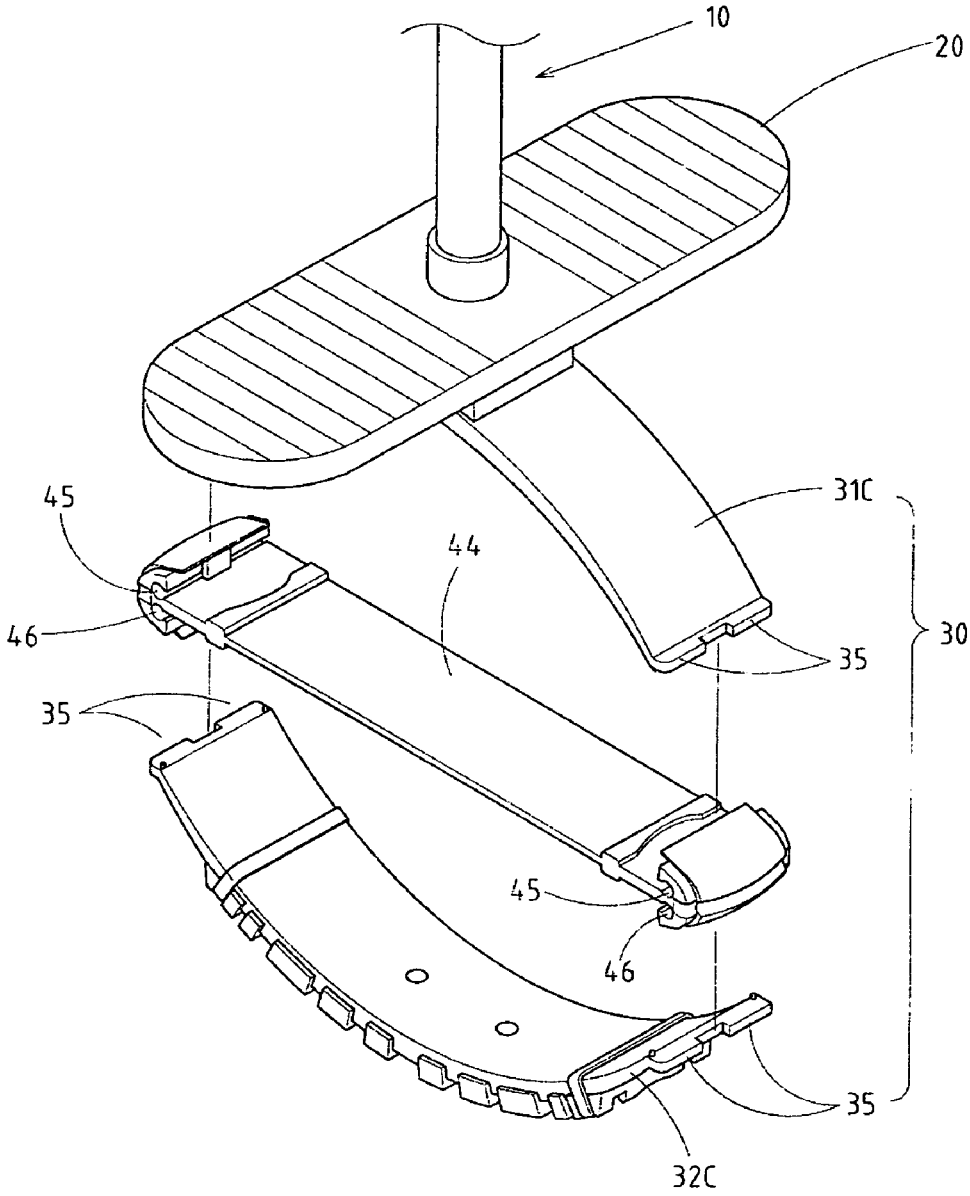

As shown in FIG. 5, the auxiliary spring component can also be a horizontal board 44. On both ends of it there are upper and lower fixing grooves 45 46, which can meet fit and fix the bolts 35 located at the horizontal ends of the upper and lower arc boards 31C 32C.

Figure 6:
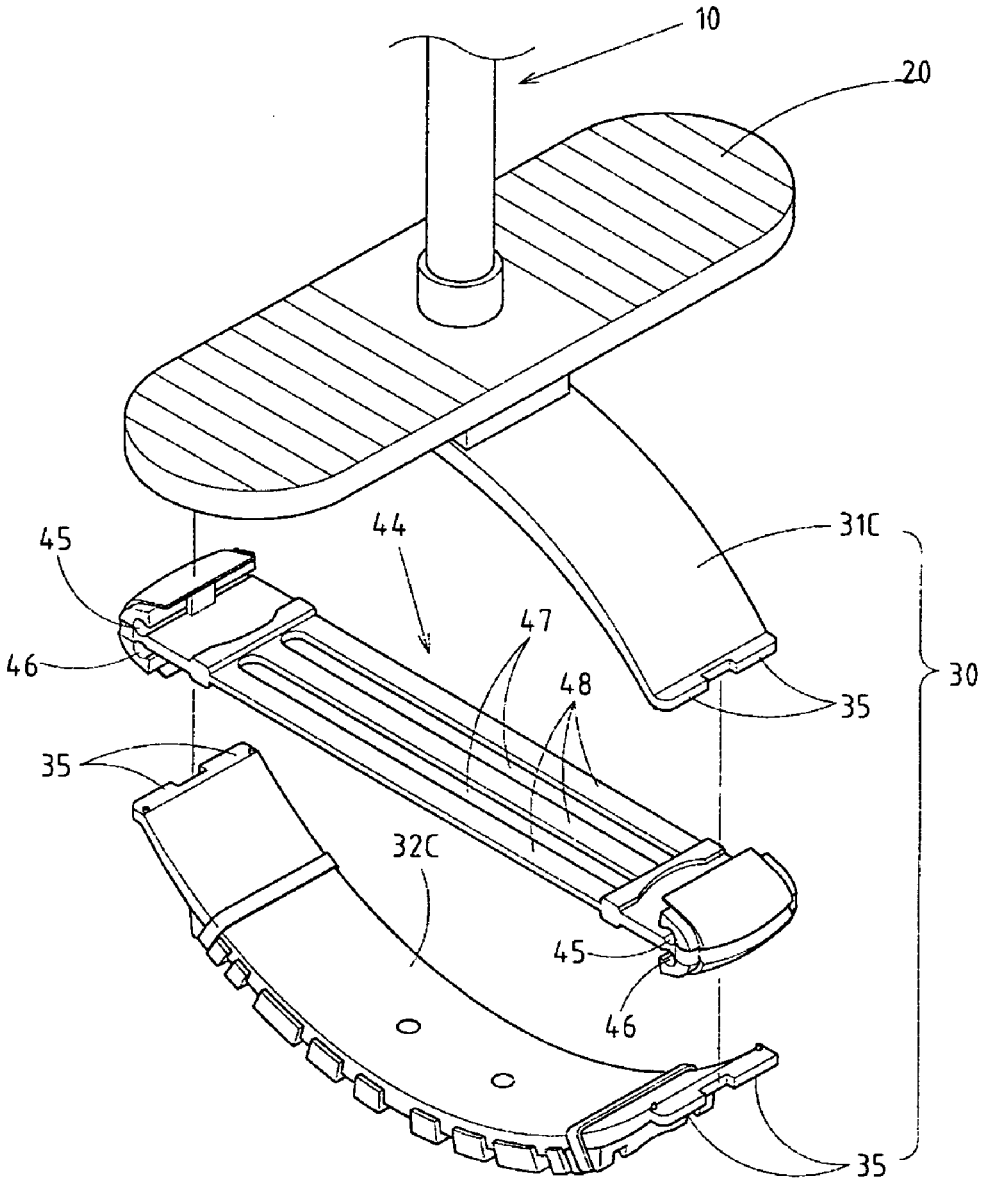
Figure 7:
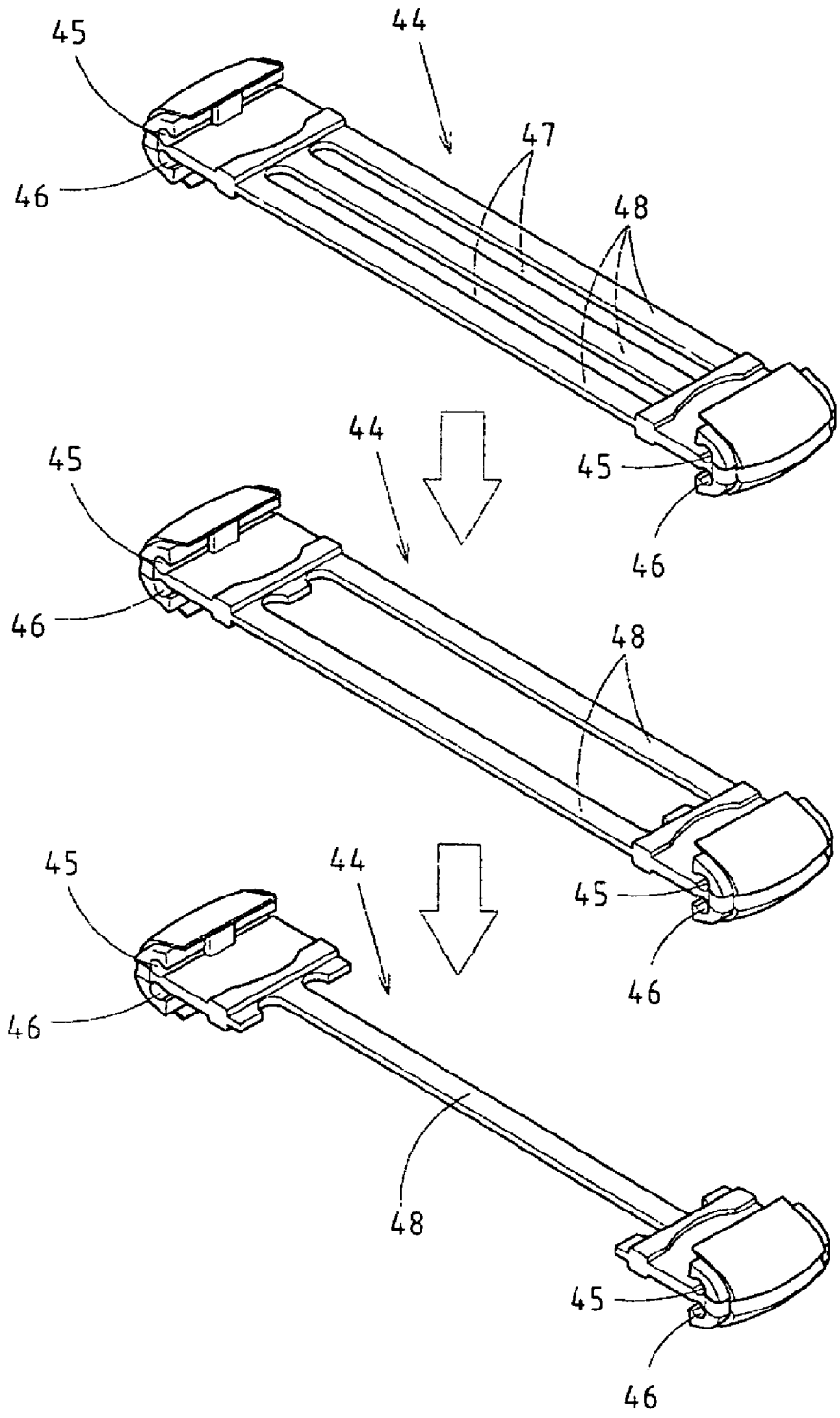
FIG. 7 shows a schematic diagram of the horizontal board in FIG. 6.

As shown in FIG. 6, in the middle of the horizontal board 44 there can be set a long-interval through groove 47, by which several separate springs 48 can be formed. Therefore the springs can be reduced and the spring force can be adjusted (refer to FIG. 7), the fewer the springs 48 are, the smaller the spring force is.

Figure 8:
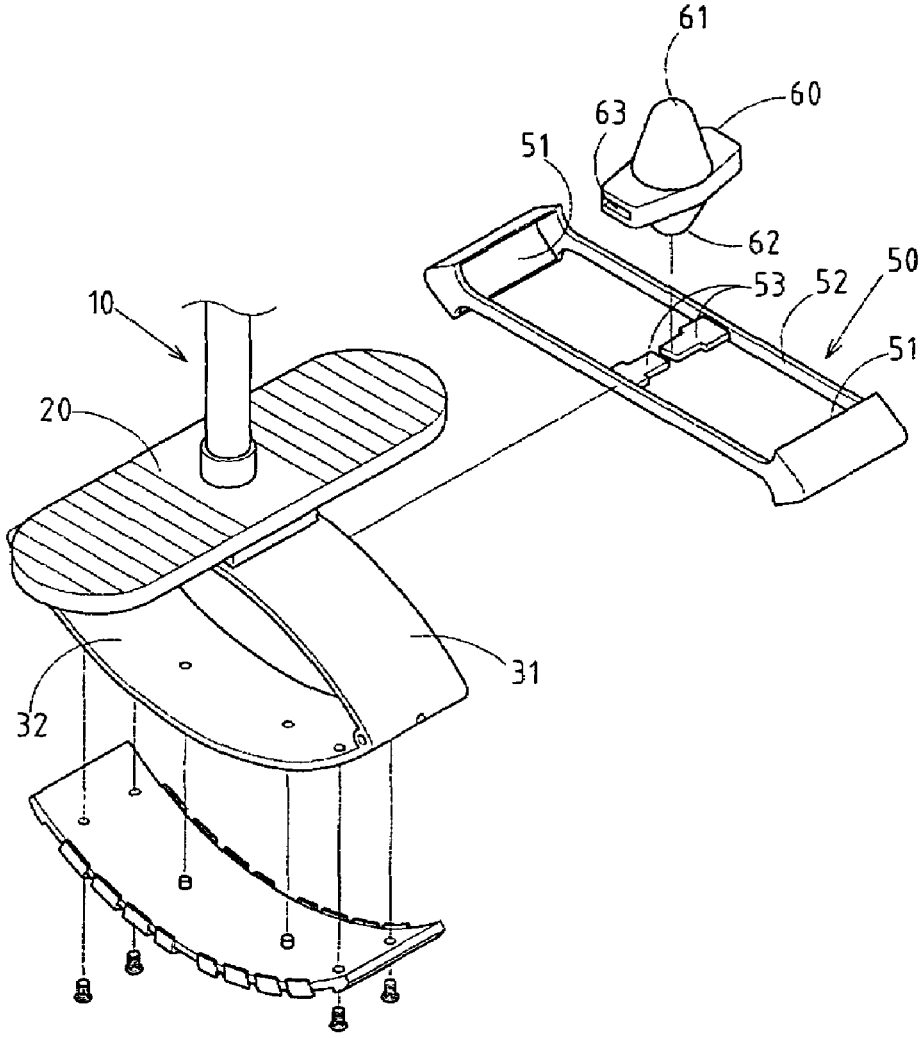
FIG. 8 shows another schematic diagram of the auxiliary spring component of the present invention.
Figure 9:
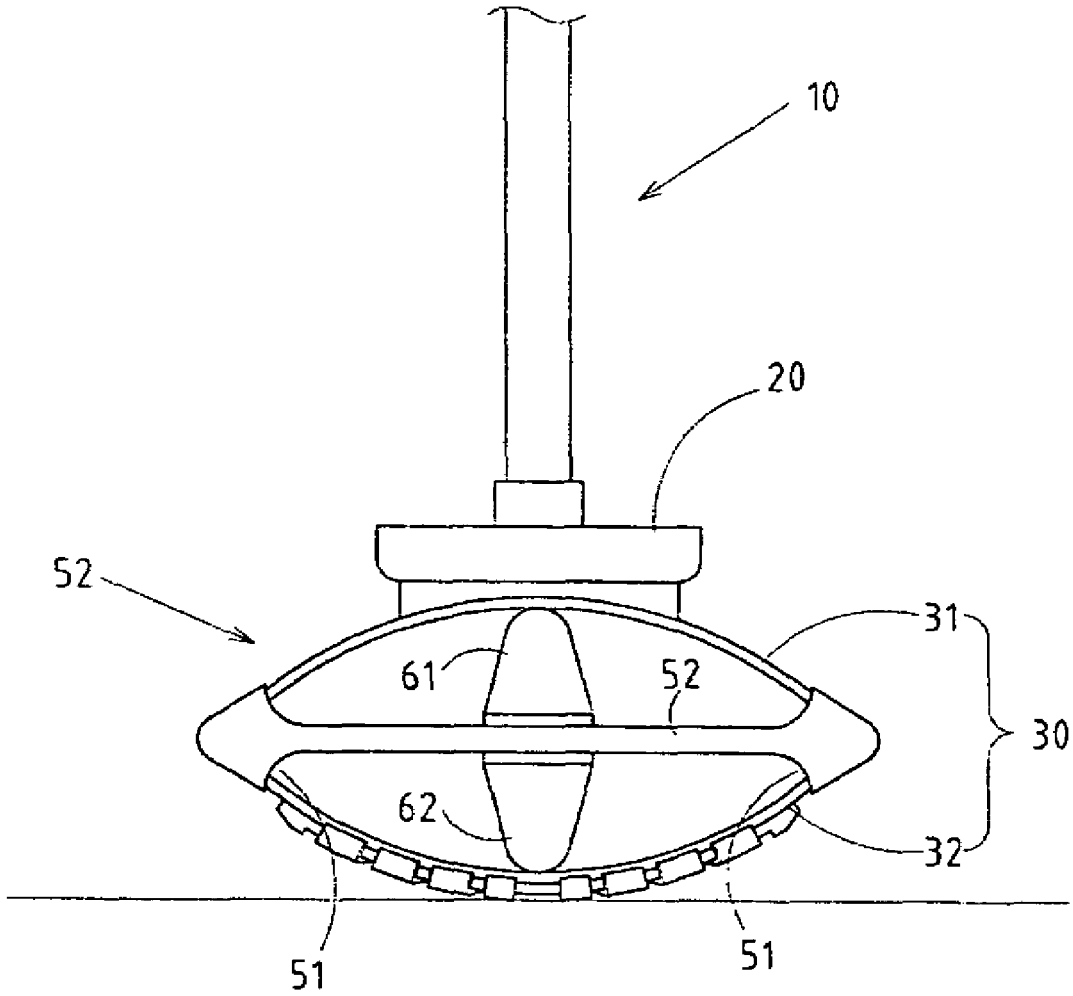
FIG. 9 shows a plane diagram of the installed structure of FIG. 8.

As shown in FIGS. 8 and 9, this auxiliary spring component can be a rectangular spring frame 50. On both ends of the longer side there are concave grooves 51, which can fit into both ends of the upper and lower arc boards 31 32. On the shorter side there are bulging parts 53 corresponding with the two side-frame 52. Furthermore, a spring block 60 is formed on both sides of which there is a concave part 63, which can fit into the bulging parts 53. The upper and lower ends 61 62 of the spring block 60 bear the upper and lower arc boards 31 32 and provides the auxiliary spring force as the upper and lower arc boards are pushed.

Figure 10:
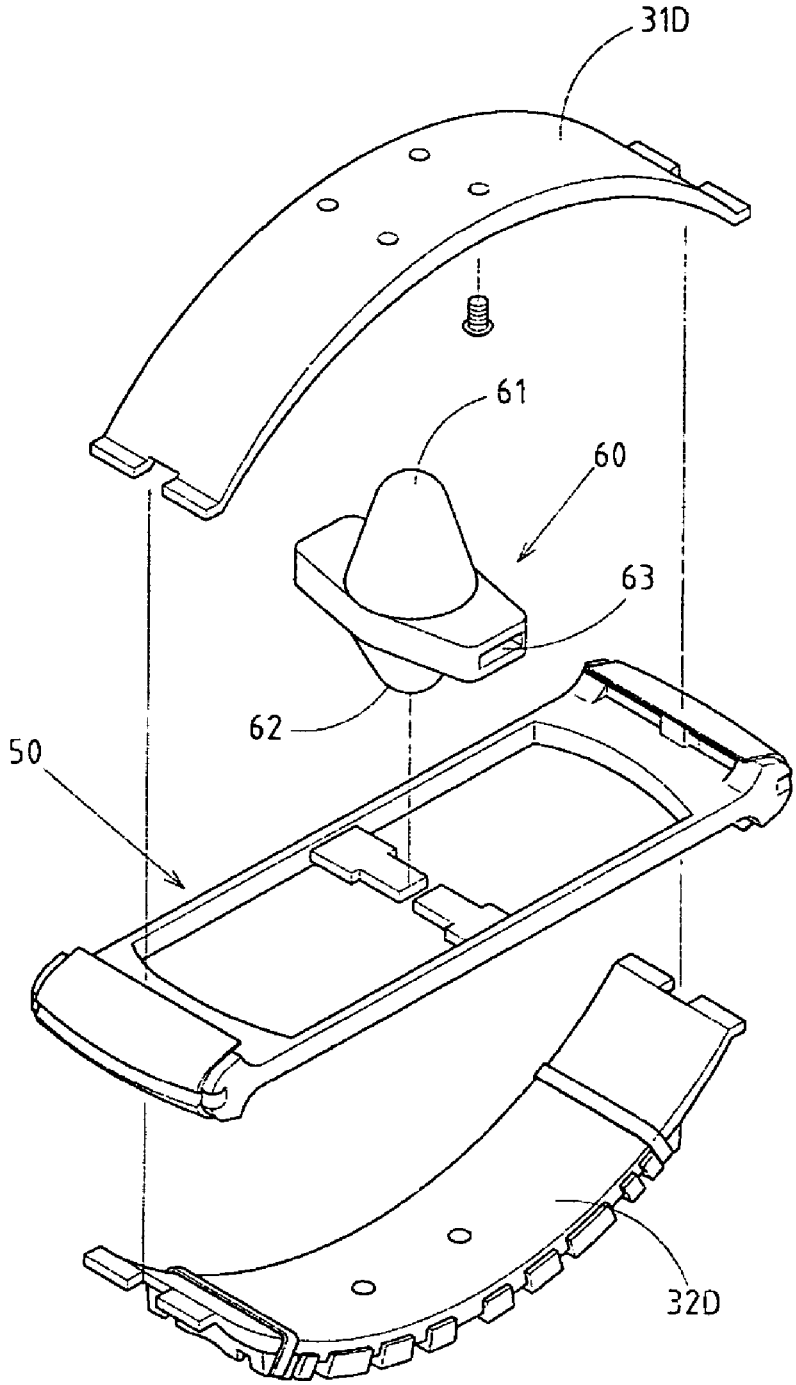
FIG. 10 shows another schematic diagram of the installed structure of FIG. 8.

As shown in FIG. 10, which is a sequel to FIG. 8 and FIG. 9, the upper and lower arc boards 31D 32D can be two separate components, which is connected with the spring frame 50 by blocking into it (as shown in FIG. 5).

Figure 11:
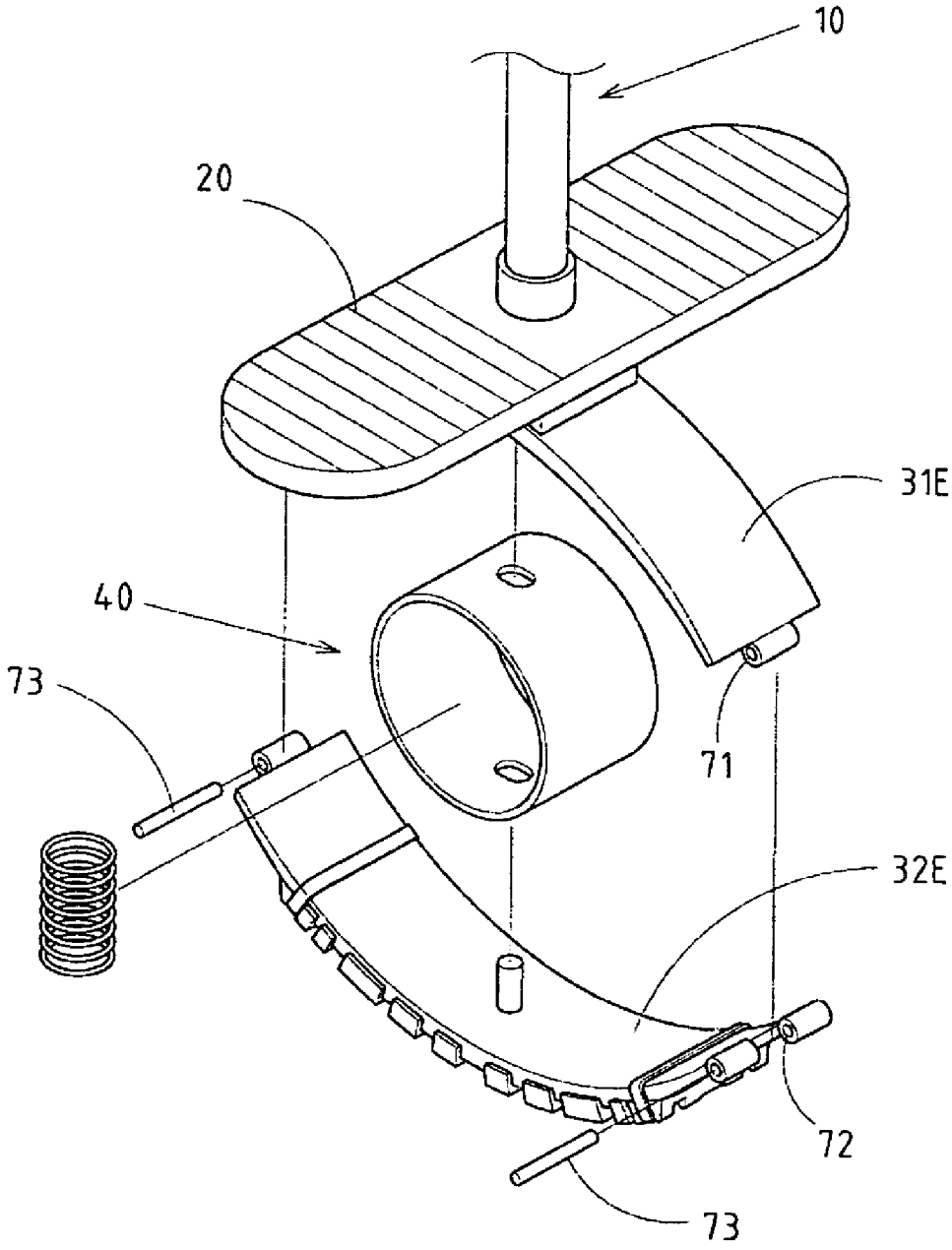
FIG. 11 shows another schematic diagram of the installed structure of upper and lower arc boards.

As shown in FIG. 4, both ends of the upper and lower arc boards 31E 32E may have corresponding through-holes 71 72 as shown in FIG. 11, which can be assembled by bolts 73.

Furthermore, the newly invented spring component 30, which is composed of upper arc board 31, lower arc board 32, and auxiliary spring component 40, can also be applied to other pedal fitness equipments, such as saddle and fitness bicycle, to achieve the same spring force as this case.

I claim:

1. A hopper apparatus comprising:

a treadle;

a handrail formed of a vertical pole and a handlebar, said vertical pole having an end affixed to said treadle, and handlebar extending transverse to said vertical pole; and a spring component affixed to an underside of said treadle and having a surface suitable for contacting an underlying surface, said spring component comprising:

an upper arc board;

a lower arc board separate of said upper arc board;

a fixing component having a first concave groove at one end affixed to a first end of said upper arc board and a first end of said lower arc board, said fixing component having a second concave groove at an opposite end affixed to a second end of said upper arc board and to a second end of said lower arc board, said fixing component comprising a rectangular spring frame with side members extending in parallel relation between said first and second concave grooves, said side members having a respective tongues aligned with each other and extending toward each other across an open interior space between said side members; and a spring block having a slot formed therein, said slot slidably receiving said tongues therein, said spring block having a first conical member extending upwardly therefrom so as to have a top end continuously bearing against an inner surface of said upper arc board, said spring block having a second conical member extending downwardly therefrom so as to have a bottom end continuously bearing against an inner surface of said lower arc board.

* * * * *